US007455620B2

(12) United States Patent
Frykman et al.

(10) Patent No.: US 7,455,620 B2
(45) Date of Patent: Nov. 25, 2008

(54) METHOD FOR INTERPRETING FORCES AND TORQUES EXERTED BY A LEFT AND RIGHT FOOT ON A DUAL-PLATE TREADMILL

(75) Inventors: Peter N. Frykman, Natick, MA (US); Everett A. Harman, Natick, MA (US); Michael E. LaFiandra, Merrimack, NH (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 761 days.

(21) Appl. No.: 10/817,915

(22) Filed: Apr. 6, 2004

(65) Prior Publication Data

US 2004/0259690 A1 Dec. 23, 2004

Related U.S. Application Data

(63) Continuation-in-part of application No. 10/393,349, filed on Mar. 21, 2003, now Pat. No. 6,878,100.

(60) Provisional application No. 60/368,807, filed on Mar. 21, 2002.

(51) Int. Cl.
*A63B 15/00* (2006.01)

(52) U.S. Cl. ..... 482/1; 482/3; 482/8; 482/51; 482/54; 600/592

(58) Field of Classification Search ..... 482/1–9, 482/51–54, 67, 900–902, 74, 100; 119/700; 434/247; 600/592, 595, 547, 300, 587, 594; 601/23, 27–35

See application file for complete search history.

(56) References Cited

U.S. PATENT DOCUMENTS 4,745,930 A * 5/1988 Confer ..... 600/592

(Continued)

FOREIGN PATENT DOCUMENTS

EP 0 603 115 A2 6/1994

(Continued)

OTHER PUBLICATIONS

Belli et al., "A Treadmill Ergometer for Three-dimensional Ground Reaction Forces Measurement During Walking," Journal of Biomechanics, 2001, vol. 34, pp. 105-112.

(Continued)

*Primary Examiner*—Glenn Richman
(74) *Attorney, Agent, or Firm*—Elizabeth Arwine

(57) ABSTRACT

A method for interpreting data representing forces and torques exerted by a right and left foot on a first and second plate treadmill to determine forces and torques exerted on the right and left foot over a specified period of time. A plurality of signals is preferably analyzed to produce data readings from the first and second plates to determine an occurrence of feet contact on the plates and feet departure from the plates. The data from the signals is then separated into a side A dataset and a side B dataset. Each of the datasets is then matched to one of the individual's feet. The resulting determination of forces and torques exerted on the feet provides a more complete analysis of an individual's progress during injury or rehabilitation.

10 Claims, 15 Drawing Sheets

U.S. PATENT DOCUMENTS

| | | | | |
|---|---|---|---|---|
| 5,299,454 | A | 4/1994 | Fuglewicz et al. | |
| 5,474,087 | A | 12/1995 | Nashner | |
| 5,476,103 | A * | 12/1995 | Nahsner | 600/595 |
| 5,623,944 | A | 4/1997 | Nashner | |
| 6,010,465 | A | 1/2000 | Nashner | |
| 6,173,608 | B1 | 1/2001 | Belli et al. | |
| 6,231,527 | B1 | 5/2001 | Sol | |
| 6,645,126 | B1 | 11/2003 | Martin | |
| 2003/0013584 | A1 | 1/2003 | Harney et al. | |
| 2003/0064869 | A1 * | 4/2003 | Reinkensmeyer et al. | 482/100 |
| 2004/0167420 | A1 * | 8/2004 | Song et al. | 600/547 |
| 2005/0010139 | A1 * | 1/2005 | Aminian et al. | 600/595 |

FOREIGN PATENT DOCUMENTS

| | | | | |
|---|---|---|---|---|
| EP | 0 603 115 A3 | 1/1998 | | |
| WO | WO 9306779 A1 * | 4/1993 | | 600/595 |

OTHER PUBLICATIONS

Kistler Instrument Corp., no title one page printout from www.kistler.ch/web/kistler_portal.nsf/urlnames/ws_multi_component_en!OpenDocument&Sub=KIC printed on Mar. 7, 2003.

John Morris Scientific, "Gaitway Instrumented Treadmill," printed from www.johnmorris.com.au/html/Kistler/bio_gaitway_treadmill.htm. on Mar. 17, 2003.

Tekscan, "Medical Sensor Catologe," revised Jan. 1, 2003, pp. 1-28.

Kaufman et al., "The Standard: Military Overuse Injury Prevention Research," Vicon Motion Systems, 1996, No. 2, pp. 1-4.

* cited by examiner

FIG. 3
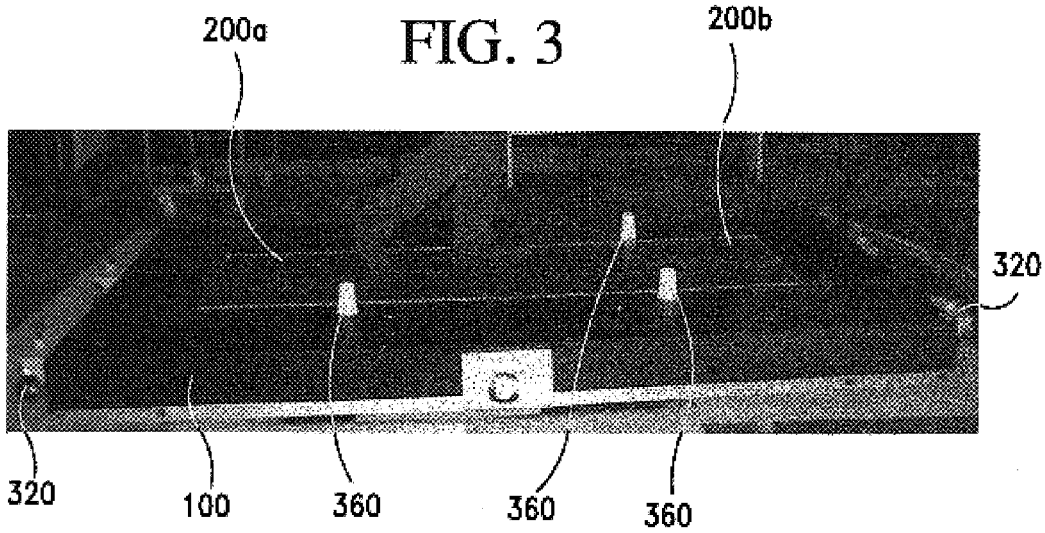
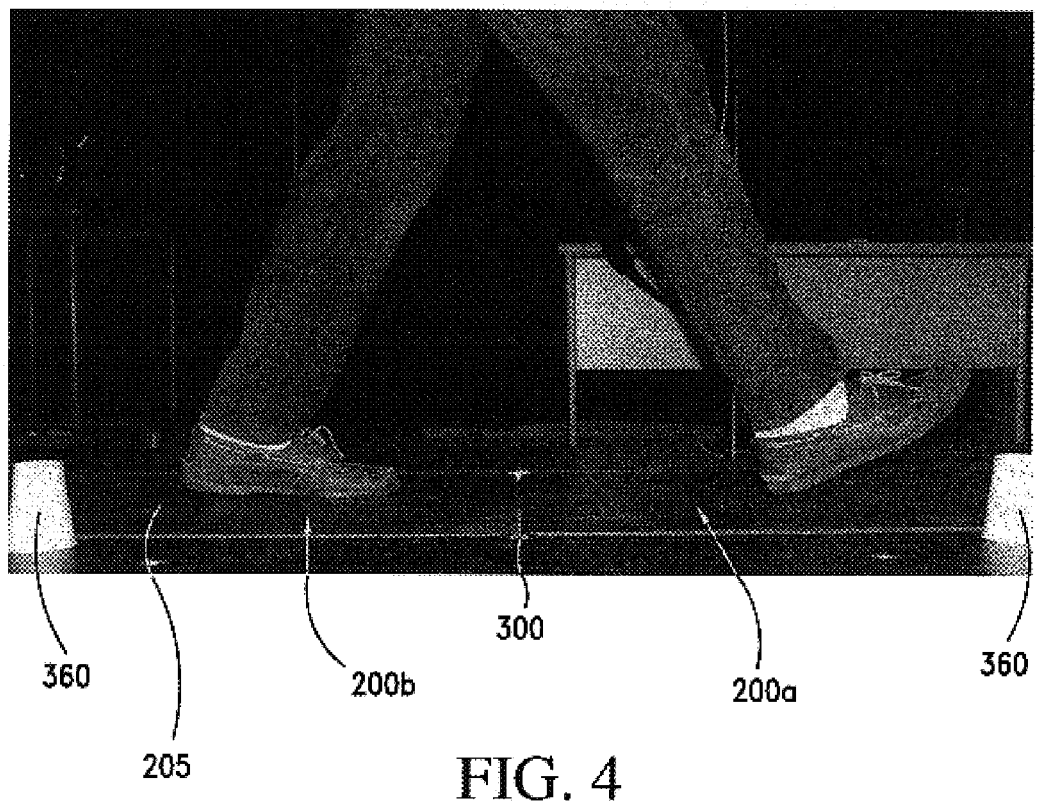
FIG. 4

FIG. 6
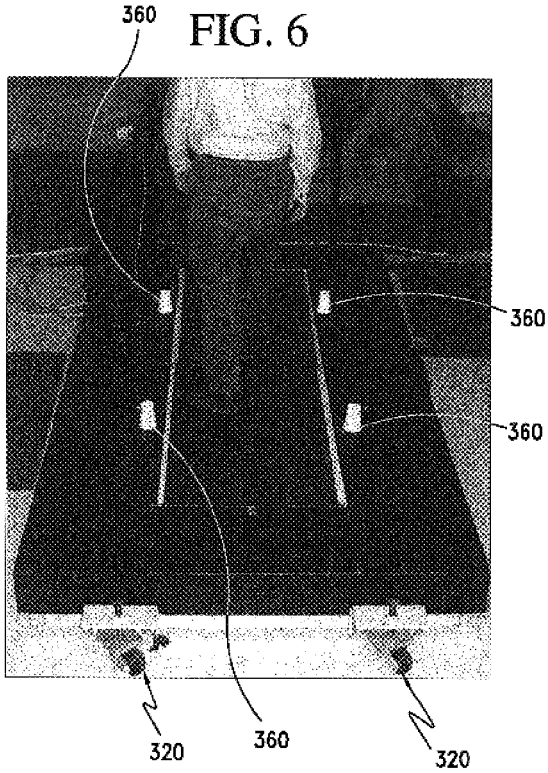
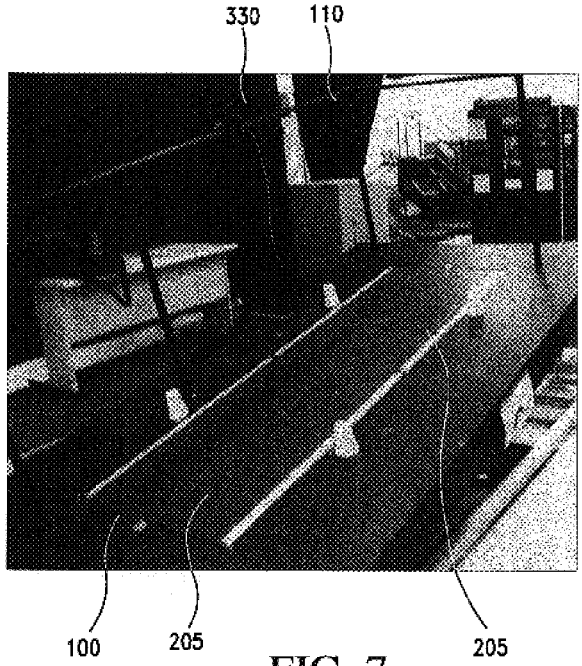
FIG. 7

METHOD FOR INTERPRETING FORCES AND TORQUES EXERTED BY A LEFT AND RIGHT FOOT ON A DUAL-PLATE TREADMILL

This application is a continuation-in-part application of U.S. patent application Ser. No. 10/393,349 filed on Mar. 21, 2003 now U.S. Pat. No. 6,878,100, which claims the benefit of U.S. provisional Application Ser. No. 60/368,807, filed Mar. 21, 2002.

I. FIELD OF THE INVENTION

The present invention relates to a device for measuring force and torque in three dimensions for both the right and left feet during walking and/or running on a treadmill. More particularly, the invention is a method for determining force and torques exerted on each foot in three dimensions during walking and/or running on a treadmill.

II. BACKGROUND OF THE INVENTION

In the event of rehabilitation following any injury or simply in order to monitor and test an individual, it is important to ascertain the forces exerted by each of the legs of the individual when, for example, walking or running normally.

Apparatus is known which can be used to measure angular variations between the tibia and femur corresponding, in particular, to movements of flexion and extension when walking. There are a variety of methods and devices that have been described in the prior art for determining quantities related to the position, magnitude and distribution of vertical forces exerted by a subject's foot (or two feet combined) against a support surface during standing or walking. The three commonly used methods and devices include coupled force transducers, instrumented shoes, and independent force transducers.

A. Coupled Force Transducers

One class of methods and devices for determining quantities related to the forces exerted on a support surface uses a forceplate that typically is a flat, rigid surface that mechanically couples three but more often four linear force transducers. The typical forceplate includes linear force transducers coupled to a substantially rigid plate to form a single force measuring surface, and each provides a way by which the force measuring surface is used to quantify aspects of the forces exerted by the feet of a subject standing on the forceplate. The most commonly determined quantities used to describe the forces exerted on a standalone forceplate surface (i.e., not part of a treadmill) by an external body are the following: (1) the position (in the horizontal plane) of the center of the vertical axis component of force, (2) the magnitude of the vertical axis component of the center of force, and (3) the magnitude of the two horizontal axis components (anteroposterior and lateral) of the center of force. Calculation of position and magnitude quantities for the vertical axis component of the center of force requires that only the vertical force component be measured by each of the three (or four) mechanically coupled force transducers. To measure the horizontal axis components of force, the force transducers must also measure the horizontal plane components of force.

The exact form of the calculations required to determine the above described center of force position and magnitude quantities from the measurement signals of the linear force transducers depends on the number and positions of the force transducers. Specifically, these algorithms must take into account the known distances between the force measuring transducers.

When a forceplate is used to measure quantities related to the position of the center of force, the position quantity is always determined in relation to coordinates of the forceplate surface. If the position of the foot exerting the force on the surface is not precisely known in relation to the forceplate surface, or if the position of the foot changes with time relative to the surface, the position of the center of vertical force cannot be determined in relation to a specified anatomical feature of the foot.

In order to measure forces exerted by the foot, there are known systems which use a platform which rests on the floor and uses sensors. The platform is located along the path that is walked in order to obtain an image of the force exerted by a footstep. Nevertheless, it appears that such a solution is not satisfactory given the fact that the person has a natural tendency to pause (or at a minimum become self-conscious of the need to hit the forceplate and alter their gait) before walking onto the platform so that the force which is exerted is not natural. This system can be duplicated for each leg. This system is not suitable for the measurement of several consecutive steps, because different individuals have their own unique gait.

B. Instrumented Shoe

A second class of methods and devices described in the prior art for measuring quantities related to forces exerted by a foot against a supporting surface during standing and walking is a shoe in which the sole is instrumented with linear force transducers. The principles for determining the position of the center of vertical force exerted on the sole of the shoe by the subject's foot are mathematically similar to those used to calculate the position of the center of force quantities using a forceplate.

Because the position of an instrumented shoe is fixed in relation to the foot, the instrumented shoe can be used to determine the position of the center of vertical force in relation to coordinates of the foot, regardless of the position of the foot on the support surface. A disadvantage of the instrumented shoe is that the position of the center of vertical force cannot be determined in relation to the fixed support surface whenever the position of the foot on the support surface changes during the measurement process. Another disadvantage in a clinical environment is that the subject must be fitted with an instrumented shoe. Another disadvantage is that thin film transducers have been difficult to calibrate and are prone to folding and bending which result in spurious output. Also, only force normal to the film surface is measured, and forces in other directions go unmeasured. Also, because the inside of the shoe is unlikely to be flat, the precise direction of the measured force is indeterminate.

The position and the magnitude of the center of force exerted by a foot against the support surface are determined relative to anatomical features of the foot by embedding force transducers in the shoes of walking and running subjects. Measures of the timing of heel-strikes and toe-offs have been made using contact switches embedded in the subject's shoes.

C. Independent Force Transducers

A fundamentally different method and device described in the prior art for determining quantities related to the forces exerted on a standalone support surface utilizes a plurality of mechanically independent vertical force transducers. Each vertical force transducer measures the total vertical force exerted over a small sensing area. The independent transducers are arranged in a matrix to form a force sensing surface.

The two-dimensional position in the horizontal plane and the magnitude of the vertical component of the center of force exerted on the sensing surface can be determined from the combined inputs of the mechanically independent transducers. When the vertical force transducers are not mechanically coupled, however, the accuracy of the center of vertical force position quantity will be lower, and depends on the sensitive area of each transducer and on the total number and arrangement of the transducers. When mechanically independent vertical force transducers are used to determine the position of the center of vertical force, the resulting quantities are determined in relation to coordinates of the force sensing surface.

The plurality of independent force measuring transducers can be used to determine additional quantities related to the distribution of forces exerted against a support surface by a subject's foot. Outlines of the foot can be produced by a system for mapping the distribution of pressures exerted by the foot on the surface. Usually the positions of anatomical features of the foot such as the heel, the ball, and the toes can be identified from the foot pressure maps. When the position of a first anatomical feature is determined in relation to the support surface by the pressure mapping means, the position of a second anatomical feature of the foot can be determined in relation to the support surface by the following procedure. The linear distance between the first and second anatomical features is determined. Then, the position of the second anatomical features in relation to the support surface is determined to be the position of the first anatomical feature in relation to the support surface plus the linear distance between the first and second anatomical features.

When a subject stands with a foot placed in a fixed position on the surface of a force sensing surface, the position of the center of force exerted by the foot can be determined in relation to coordinates of the forceplate surface. If the position of a specified anatomical feature of the foot (for example, the ankle joint) is also known in relation to the coordinates of the forceplate surface, the position of the center of force in relation to coordinates of the specified anatomical feature of the foot can be determined by a coordinate transformation in which the difference between the force and anatomical feature position quantities are calculated.

Forceplates, instrumented shoes and independent force transducers have all been used in the prior art to measure quantities related to the position and magnitude of the center of force exerted by each foot against the support surface during stepping-in-place, walking, and running. Forceplates embedded in walkways have measured quantities related to the position and magnitude in relation to the fixed (forceplate) support surface for single strides during over ground walking and running. Using additional information on the position of a specified anatomical feature of the foot in relation to the forceplate support surface, the position of the center of force has also been determined in relation to a specified anatomical feature of the foot.

Human gait may be classified in general categories of walking and running. During walking, at least one foot is always in contact with the support surface and there are measurable periods of time greater than zero during which both feet are in contact with the support surface. During running, there are measurable periods greater than zero during which time neither foot is in contact with the support surface and there are no times during which both feet are in contact with the support surface.

Walking can be separated into four phases, double support with left leg leading, left leg single support, double support with right leg leading, and right leg single support. Transitions between the four phases are marked by what are generally termed "heel-strike" and "toe-off" events. The point of first contact of a foot is termed a "heel-strike", because in normal adult individuals the heel of the foot (the rearmost portion of the sole when shoes are worn) is usually the first to contact the surface. However, heel-strike may be achieved with other portions of the foot contacting the surface first. During running, normal adult individuals sometimes contact with the ball of the foot (forward portions of the sole when shoes are worn). Individuals with orthopedic and/or neuromuscular disorders may always contact the surface with other portions of the foot or other points along the perimeter of the sole when shoes are worn. Similarly, while the ball and toes of the foot are the last to contact the surface at a toe-off event in normal adults, a patient's last point of contact may be another portion of the foot. Thus, regardless of the actual points of contact, the terms heel-strike and toe-off refer to those points in time at which the foot first contacts the support surface and ceases to contact the support surface, respectively.

Treadmills allowing a subject to replicate walking and running speeds within a confined space have been described, for example, in U.S. Pat. No. 5,299,454 to Fuglewicz et al. and U.S. Pat. No. 6,010,465 to Nashner. A treadmill allows the difficulty of gait to be precisely set by independently controlling the belt speed and the inclination of the belt; however, prior art devices known to the inventors have not allowed for the slope to be changed from an incline to decline (or decline to incline) while an individual is using the treadmill. The subject can be maintained in a fixed position relative to the measuring surface underlying the treadmill belt by coordinating the speed of gait with the speed of the treadmill belt movement.

One method to determine the position of the treadmill belt on a continuous basis in relation to the fixed force sensing surface is to use one of several sophisticated commercial treadmill systems described in the prior art which measure the anteroposterior speed of the moving treadmill belt on a continuous basis, and which provide the means to regulate the belt anteroposterior speed on a continuous basis. When one of these treadmill systems is used, the information necessary to determine the continuous position of the treadmill belt in relation to the underlying forceplate is obtained by performing mathematical integration of the belt speed signal on a continuous basis.

There are methods described in the prior art which can be used to determine, at the time of heel-strike, the position of the moving treadmill belt in relation to the specified anatomical features of the foot. One method is to use one of several commercially available optical motion analysis systems. Two examples of commercially available motion analysis systems which describe applications for tracking the motions of identified points on the human body during locomotion include the ExpertVision system manufactured by MotionAnalysis Corp., Santa Rosa, Calif. and the Vicon system manufactured by Oxford Medilog Systems, Limited, Oxfordshire, England. In accordance with this method, one or more optical markers are placed on the specified anatomical features of the foot. One or more additional markers are placed on the treadmill belt at predetermined positions. The number and placement of the optical markers on the anatomical feature and the treadmill belt determine the accuracy of the measurement as specified by the systems manufacturers. At the time of heel-strike, the positions of the treadmill belt marker or markers are then determined in relation to the positions of the anatomical feature marker or markers in accordance with methods specified by the system manufacturer.

There have been numerous proposals and/or attempts to equip endless belts in an attempt to measure the loads applied when an individual walks. These systems involve fitting force meters between the base over which one side of the endless belt travels and the chassis. However, such proposals and/or attempts have several drawbacks. First, the measurement cannot differentiate between the force exerted by each leg; this poses relatively few problems when analyzing running motion because both feet practically never touch the ground simultaneously since contact is essentially one-footed, but it is an important shortcoming when the individual is walking because both feet always touch the ground since contact is two-footed as discussed above. Second, it is impossible to measure tangential forces in the x-axis and y-axis. Third, most studies have made a conscious decision not to try to capture the forces and torques in the horizontal plane caused by a footfall, probably given the relatively small contribution these forces have on the overall force analysis when compared to the vertical force.

U.S. Pat. No. 5,299,454 to Fuglewicz et al. and U.S. Pat. No. 6,010,465 to Nashner disclose a solution whereby the endless belt has a path around at least two forceplates in tandem. This solution has the inherent problem in that when the individual has both feet on the belt at the same time, the horizontal forces from one foot cancel out the horizontal forces of the other foot because the belt is pushed in opposite directions by the two feet. The other solution using a treadmill structure with multiple forceplates is discussed, for example, in U.S. Pat. No. 6,173,608 to Belli et al., which discloses a treadmill structure that has a pair of belts running in the longitudinal direction. The inherent problem with this structure is that the normal walking or running gait for people eventually places the feet one in front of each other such that the individual would have heel-strikes over the gap between the belts and thus register forces on both belts at the same time, which defeats the purpose of the device.

In light of the above drawbacks of the prior art described above, what is needed is a method and device for separately determining quantities related to the force exerted by each foot against the treadmill support surface at all phases of the step cycle.

Moreover, what is needed is a method for determining the forces and torques exerted on each foot as it moves from one surface of a treadmill to another. Such a method should calculate the location of these forces and torques on the treadmill surface.

III. SUMMARY OF THE INVENTION

According to one aspect of the invention, a force sensing treadmill including a chassis, a pair of treadmill units connected to the chassis such that the treadmill units are arranged in tandem and each of the treadmills having a belt, and a forceplate in communication with the belt.

According to one aspect of the invention, an apparatus for providing a plurality of signals representing forces and torques in the x-axis, y-axis, and z-axis resulting from contact between a foot and the apparatus, the apparatus including a support structure, a front treadmill unit connected to the support structure, the front treadmill having a plurality of rollers, a belt in communication with the plurality of rollers, a drive system in communication with at least one of the plurality of rollers, and a forceplate in communication with the belt; and a rear treadmill unit connected to the support structure, the rear treadmill unit having a plurality of rollers, a belt in communication with the plurality of rollers, a drive system in communication with at least one of the plurality of rollers, and a forceplate in communication with the belt; and wherein the front treadmill and the rear treadmill are in tandem to each other, and the forceplates measure $F_x$, $F_y$, $F_z$, $M_x$, $M_y$, and $M_z$ for each heel-strike.

According to one aspect of the invention, an apparatus for providing a plurality of signals representing forces and torques in the x-axis, y-axis, and z-axis resulting from contact between a foot and the apparatus, the apparatus including a support structure, a front treadmill unit connected to the support structure, the front treadmill unit having a plurality of rollers, a belt in communication with the plurality of rollers, a motor in communication with at least one of the plurality of rollers, and a forceplate in communication with the belt; and a rear treadmill unit connected to the support structure, the rear treadmill unit having a plurality of rollers, a belt in communication with the plurality of rollers, a motor in communication with at least one of the plurality of rollers, and a forceplate in communication with the belt; and wherein the front treadmill and the rear treadmill are in tandem to each other.

According to an aspect of the invention, a gap between two tandem treadmill units is minimized so that the gap does not interfere with a normal walking or running gait, does not distract the individual on the treadmill, and reduces its impact as a safety hazard.

According to another aspect of the invention, a method is provided for interpreting data regarding the forces and torques exerted on each force plate of the treadmill to determine forces and torques exerted on each foot. In particular, a method for interpreting data representing forces and torques exerted by a right and left foot on a first and second plate of the treadmill to determine forces and torques exerted on the right and left foot, over a specified period of time is provided. The method includes analyzing a plurality of signals producing data output from the first and second plates to determine an occurrence of heel-strikes on the plates and toe-off events from the plates. For each one of the plurality of signals, frame numbers are determined wherein the frame numbers correspond to a stride of an individual. Each frame includes a beginning point and an end point. Data is then extracted for a first side and a second side from each of the first and second plates to obtain a first side data total and a second side data total. Finally, it is determined which one of the feet corresponds to the first side data and which one of the feet corresponds to the second side data.

According to yet another aspect of the invention, the force sensing treadmill includes computer readable instructions for interpreting data representing forces and torques exerted by a right and left foot on the treadmill to determine forces and torques exerted on the right and left foot, over a specified period of time.

According to another aspect of the invention, an article of manufacture comprising a computer usable medium having computer readable program code means embodied therein for causing a computer to perform the method for interpreting data referenced above.

According to another aspect of the invention, a computer data signal embodied in a carrier wave readable by a computing system and encoding a computer program of instructions for executing a computer process performing the method for interpreting data referenced above.

An objective of at least one embodiment of the invention is to have a stable treadmill that is not subject to perceptibly swaying or vibration during use.

An objective of at least one embodiment of the invention is to have a variety of speeds possible and have close synchronization between the two treadmills.

An objective of at least one embodiment of the invention is to have a treadmill capable of allowing both uphill and downhill activities to be studied during one continuous session and providing a variety of grades.

An objective of at least one embodiment of the invention is to handle large loads on the treadmill to allow for testing of a variety of individuals including encumbered individuals.

An objective of at least one embodiment of the invention is to measure $F_x$, $F_y$, $F_z$, $M_z$, $M_y$, and $M_z$ on both treadmill units while providing the signals to an external component. The invention also measures the center of pressure on both treadmill units.

An objective of at least one embodiment of the invention is to allow sufficient portability around the inside of a laboratory and allow for transportation to other locations external to the laboratory.

An objective of at least one embodiment of the invention is to not allow the structure to interfere with a motion capture system used for video analysis of movement.

An objective of at least one embodiment of the invention is to improve efficiencies in research and gathering data from other prior art methods and devices both in terms of the number of subjects, the number of data points, and the quality of data.

An objective of at least one embodiment of the invention is to allow an entire model and analysis to be done of the forces and torques in the joints and other connection points within the individual.

An advantage of at least one embodiment of the invention is that it is capable of measuring $F_x$, $F_y$, $F_z$, $M_x$, $M_y$, and $M_z$ on both treadmill units.

An advantage of at least one embodiment of the invention is that it does not interfere with the normal gait of an individual anymore than a one belt treadmill system.

An advantage of at least one embodiment of the invention is that it is able to separate the forces caused by one foot from the forces caused by the other foot.

An advantage of at least one embodiment of the invention is that it converts information from electrical current representing forces and torques exerted on each force plate of a treadmill to forces and torques exerted on each foot.

Given the following enabling description of the drawings, the apparatus and method of the present invention should become evident to a person of ordinary skill in the art.

IV. BRIEF DESCRIPTION OF THE DRAWINGS

The use of cross-hatching or shading within these drawings should not be interpreted as a limitation on the potential materials used for construction. Like reference numerals in the figures represent and refer to the same element or function.

FIG. 1 illustrates a top view of a preferred embodiment according to the invention.

FIGS. 2(*a*) and 2(*b*) depict side views of the treadmill unit components according to an embodiment of the invention.

FIG. 3 illustrates a perspective top view of the treadmill unit according to an embodiment of the invention.

FIG. 4 depicts an individual walking on the treadmill unit according to an embodiment of the invention.

FIG. 6 depicts a rear view of the treadmill unit in an inclined position during use according to an embodiment of the present invention.

FIG. 7 illustrates a perspective rear view of the treadmill unit in an inclined position according to an embodiment of the invention.

Figure 14A:
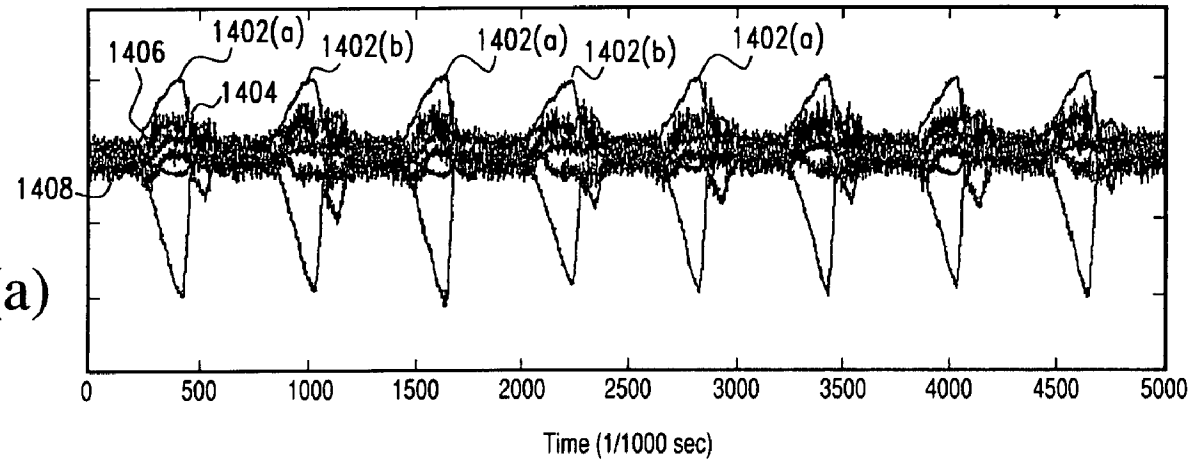
Figure 14B:
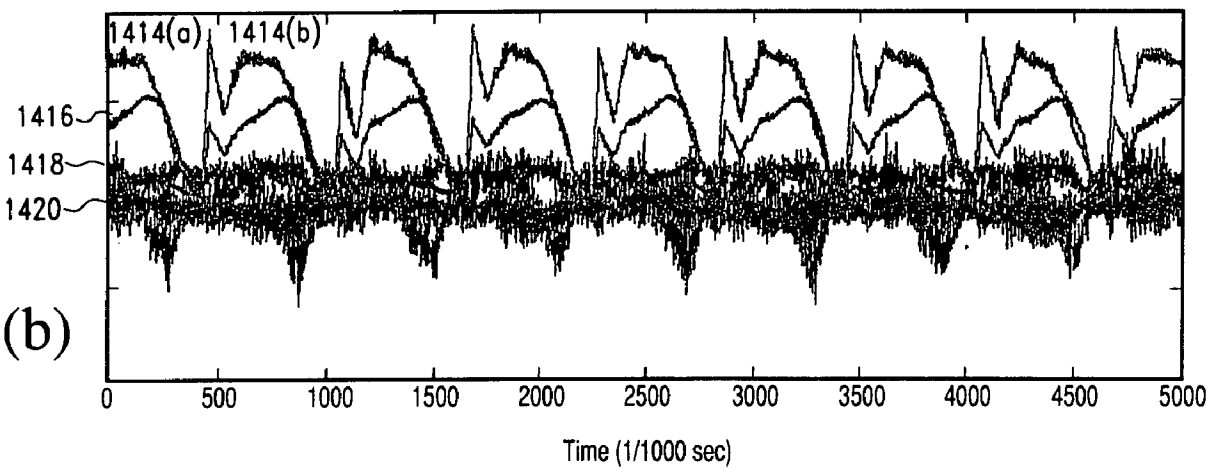

FIGS. 14(*a*) and 14(*b*) are diagrams depicting the configuration of exemplary signals in Voltages according to an embodiment of the present invention.

Figure 15A:
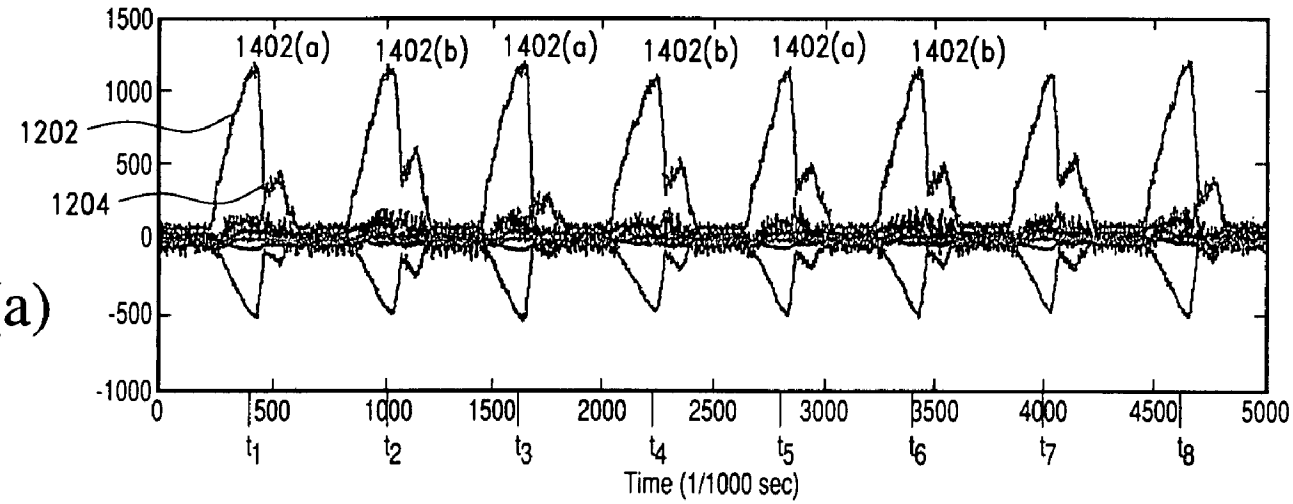
Figure 15B:
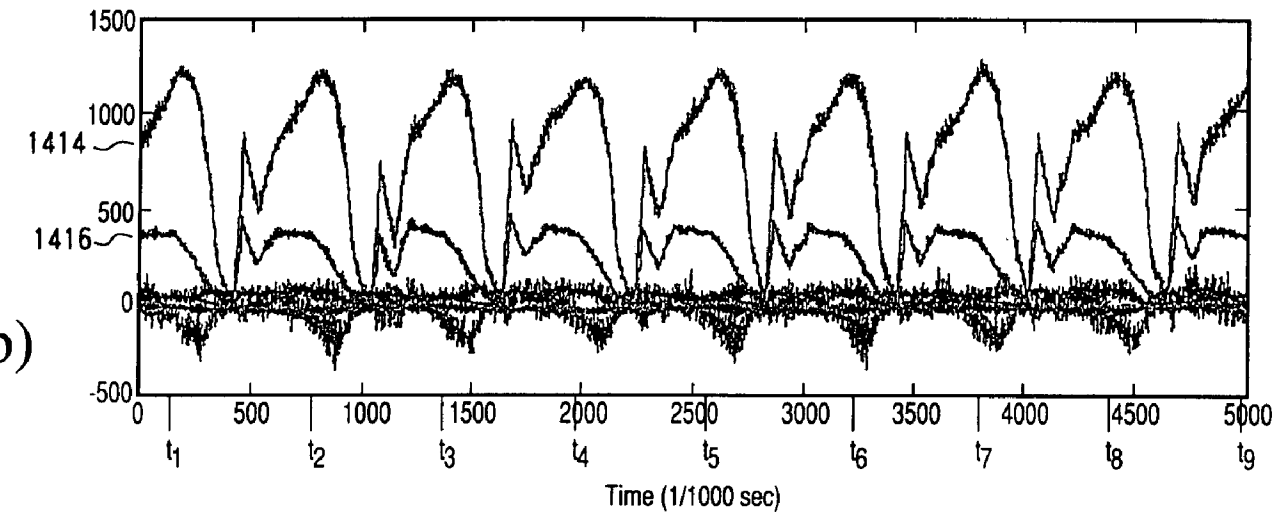

FIGS. 15(*a*) and 15(*b*) are diagrams depicting the signals of FIGS. 14(*a*) and 14(*b*), respectively, in Newtons.

Figure 16A:
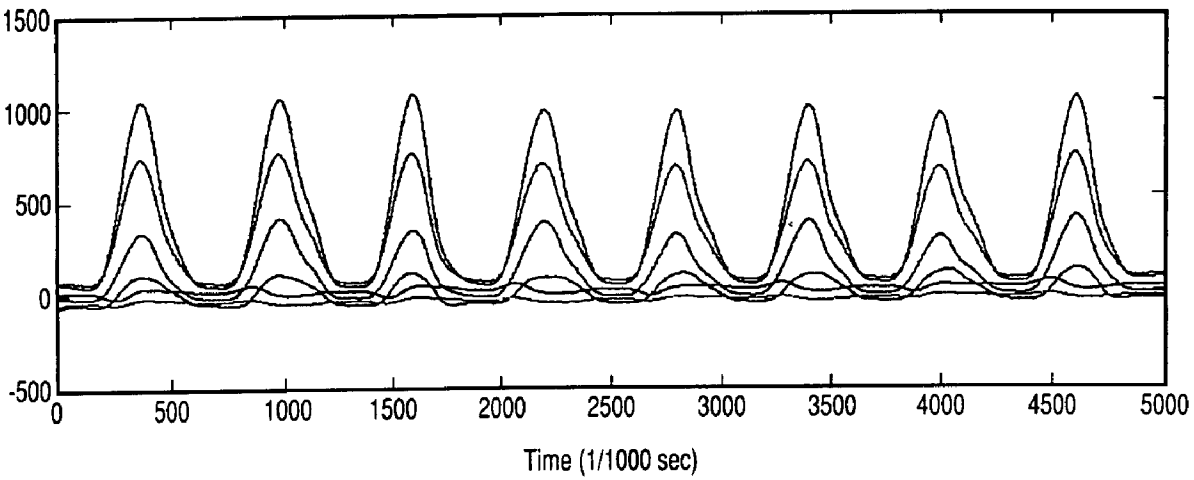
Figure 16B:
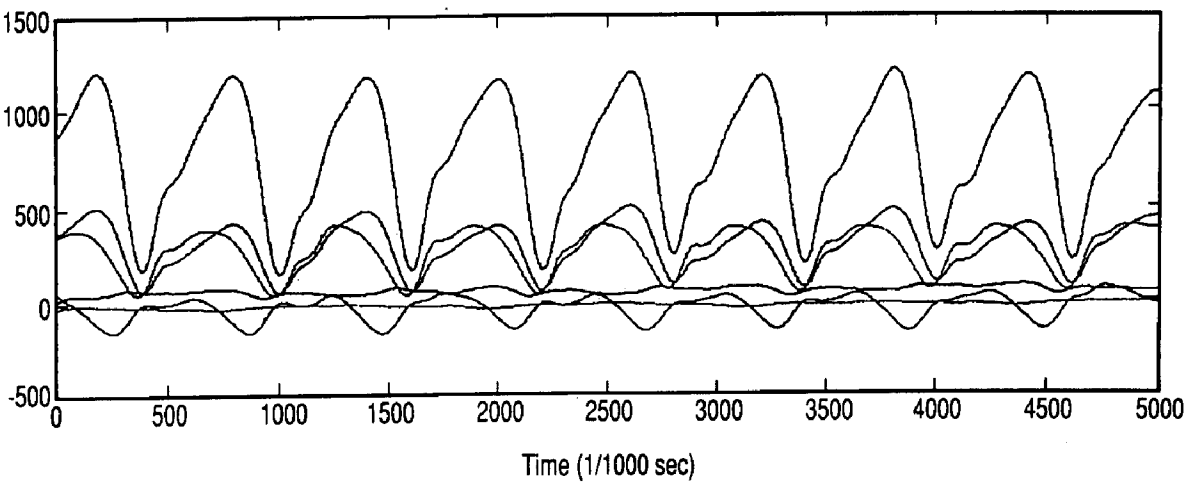

FIGS. 16(*a*) and 16(*b*) are diagrams depicting the signals of FIGS. 15(*a*) and 15(*b*), respectively, after they have been filtered.

Figure 17A:
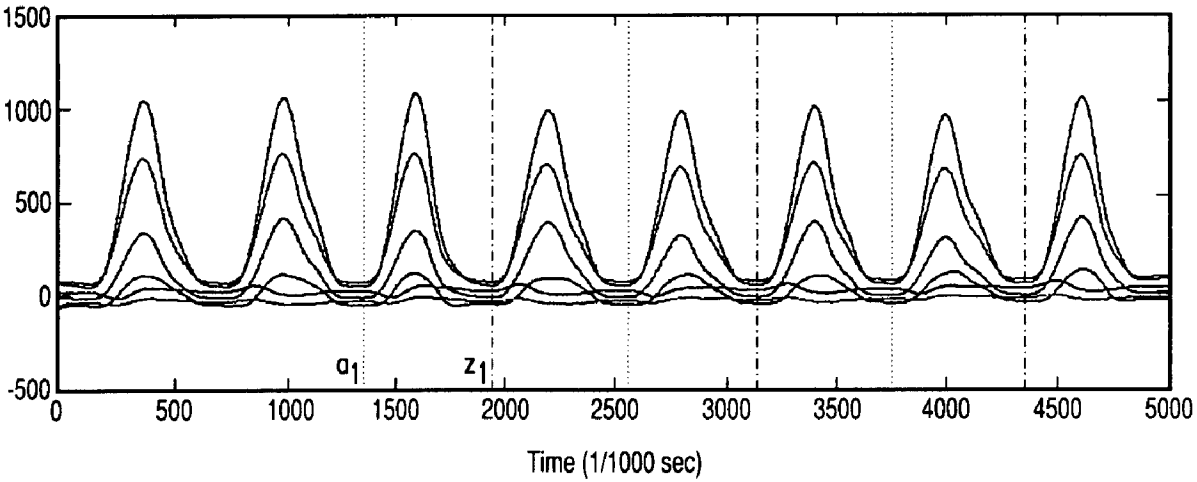
Figure 17B:
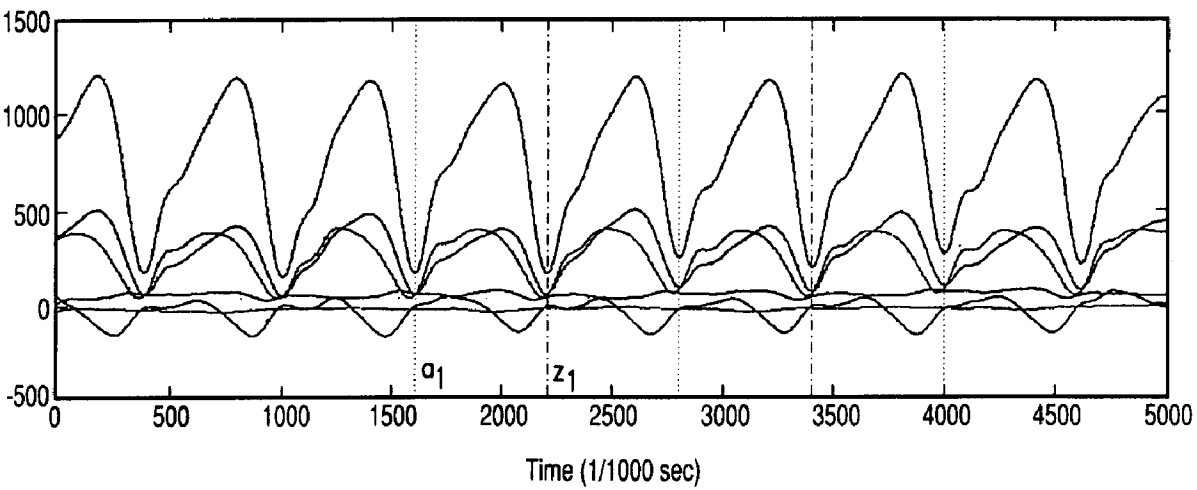

FIGS. 17(*a*) and 17(*b*) are diagrams depicting the signals of FIGS. 16(*a*) and 16(*b*), respectively, after they have been divided into frames.

Figure 18A:
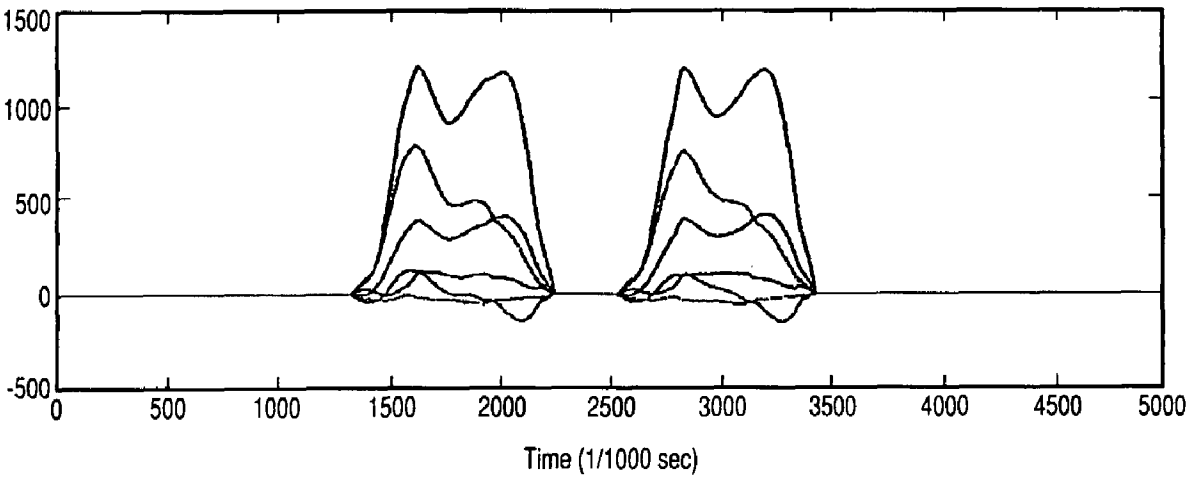
Figure 18B:
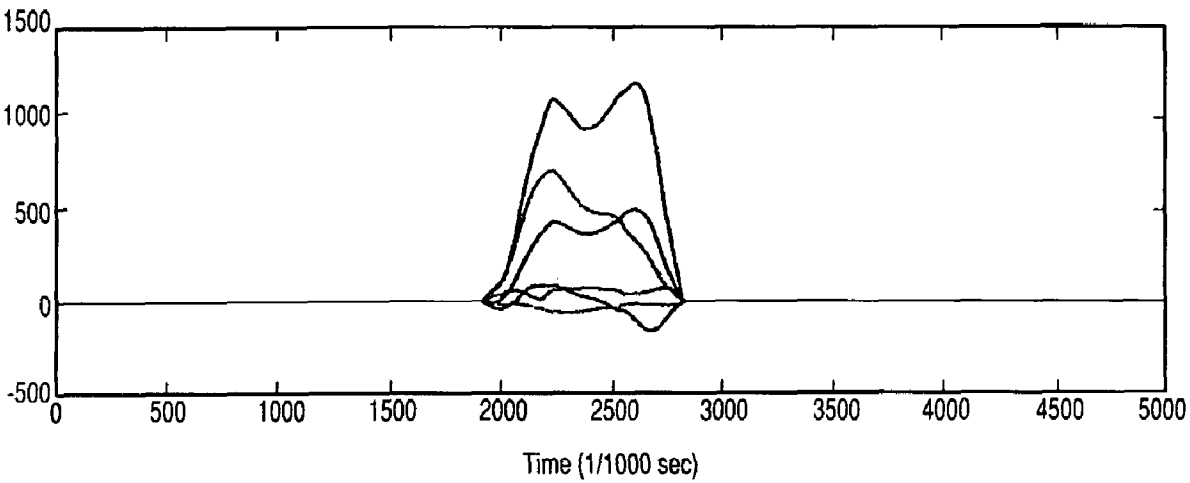

FIGS. 18(*a*) and 18(*b*) are diagrams depicting the signals of FIGS. 15(*a*) and 15(*b*) after they have been divided into side A data and side B data.

Figure 19:
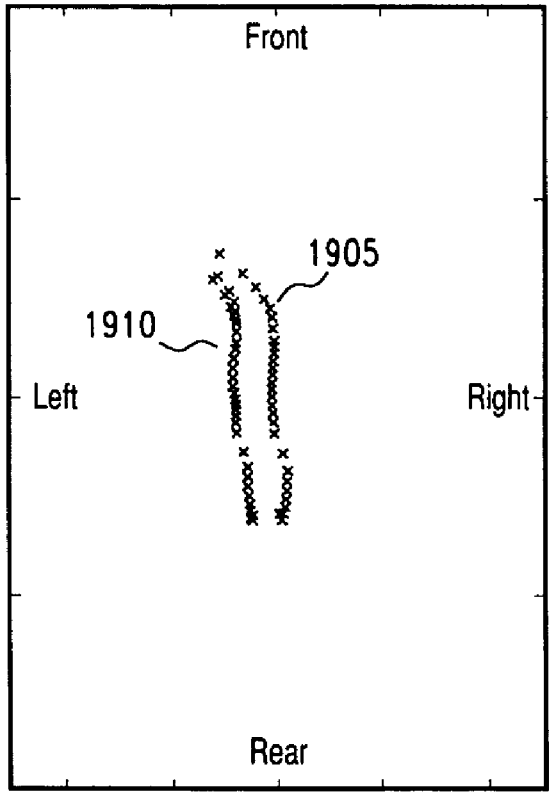

FIG. 19 is a diagram depicting trajectories for side A data and side B data.

V. DETAILED DESCRIPTION OF THE DRAWINGS

Figure 1:
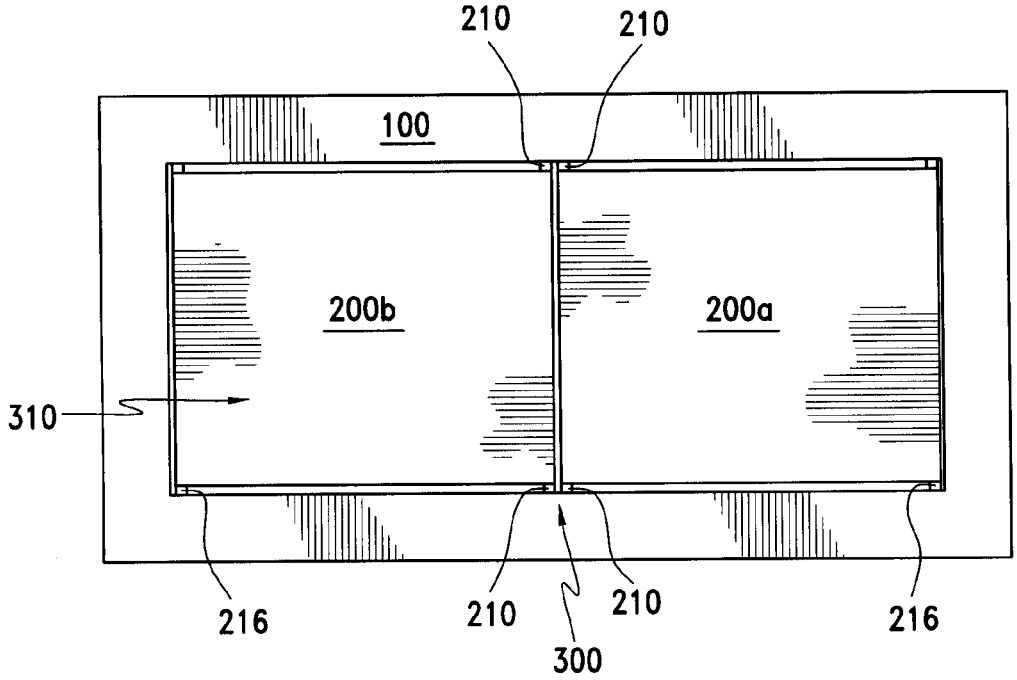
Figure 11:
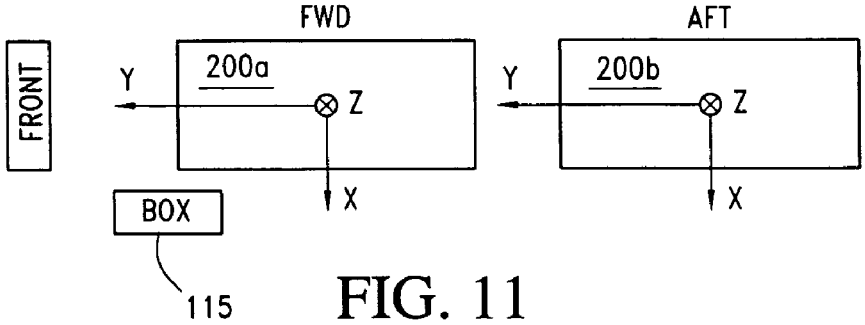
FIG. 11 depicts a block diagram representation of the forces and torques measured by an embodiment of the invention.

The present invention preferably is a treadmill for measuring $F_x$, $F_y$, $F_z$, $M_x$, $M_y$, and $M_z$ for each foot individually as illustrated in the block diagram shown in FIG. 11. Referring now to FIG. 1, the treadmill preferably includes a support structure (or means for providing support or chassis) 100 and two treadmill units 200*a*, 200*b* in tandem within the support structure 100 such that an individual is able to, for example, run or walk on the top surface of each treadmill unit 200*a*, 200*b*. More preferably, the gap 300 present between the tandem treadmill units 200*a*, 200*b* is minimized such that a foot usually easily passes from the front treadmill unit 200*a* to the rear treadmill unit 200*b* during use.

Figure 2A:
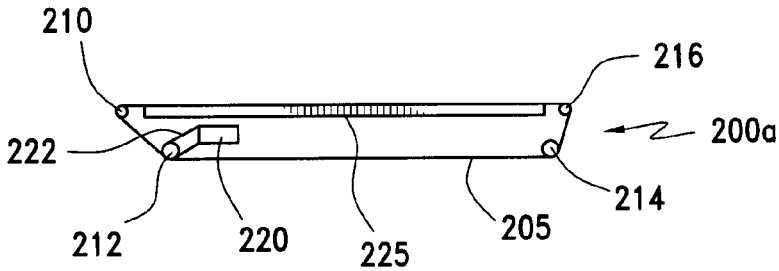
Figure 2B:
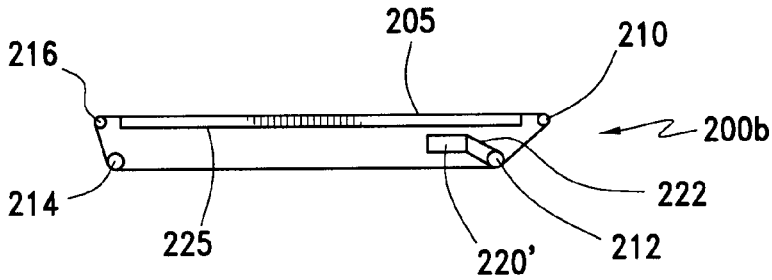

As shown in FIGS. 2(*a*) and 2(*b*), each treadmill unit 200*a*, 200*b* preferably includes a belt (or movable support surface) 205, a plurality of rollers 210, 212, 214, 216, a drive system such as a motor 220, and a force sensing member such as a forceplate 225. The forceplate 225 preferably includes a plurality of transducers to detect the force applied by an individual's feet through the belt onto the forceplate; and more preferably, there are four transducers each located in a respective corner of the forceplate 225. A suitable forceplate for use in this invention is manufactured by Advanced Mechanical Technologies, Inc. of Newton, Mass., which uses mechanically coupled multi-axis force transducers to measure all of the vertical axis, longitudinal horizontal axis, and lateral horizontal axis force components. The drive system 220 preferably drives roller 212 via a pulley 222.

The plurality of rollers preferably number four to support the belt as illustrated, for example, in FIGS. 1-2(*b*). The roller 210 along the top surface nearest the other tandem treadmill unit preferably has a small diameter to further minimize the space 300 between the tandem treadmill units because the radius of the roller 210 is small (particularly when compared to the other rollers 212, 214, 216) which decreases the distance across the gap 300.

Preferably, the two treadmill units 200*a*, 200*b* are in communication and jointly controlled such that the motor 220 in the front treadmill unit 200*a* is the master while the motor 220' in the aft (or rear) treadmill unit 200*b* is the follower. This relationship allows for the aft treadmill unit 200*b* to adjust its speed to match that of the front treadmill unit 200*a*. For example, when an individual has a heel-strike on the front treadmill unit 200*a*, a braking force is applied, thus slightly slowing the front treadmill unit 200*a* which in turn will slow the aft treadmill unit 200*b* to correspond to the speed of the front treadmill unit 200*a*, but as the front treadmill unit 200*a* increases, the speed of the aft treadmill unit 200*b* will increase to correspond to the acceleration of the front treadmill unit 200*a*. This locking speed also occurs when the front treadmill unit 200*a* may increase in speed, resulting in the aft treadmill unit 200*b* increasing speed to match the resulting speed and the acceleration. Preferably, the motors 220, 220' are able to run the belts at a speed between 0 and 10.8 MPH (including the end points), while maintaining synchronicity in speed within 0.5%. An additional range of speed can be 0 to 10 MPH (including the end points). The motors 220, 220' preferably are heavy duty servo control motors to allow for easier implementation of the invention.

The tandem treadmill units 200*a*, 200*b* form together a support surface 310 upon which an individual is able to travel at a variety of speeds that accommodate walking and running, as shown in FIG. 1.

The support structure 100 preferably includes the housing for both treadmill units 200*a*, 200*b*. The housing preferably encloses the treadmill units 200*a*, 200*b* around their respective exposed sides (i.e., the sides that do not face the other treadmill unit) as illustrated, for example, in FIGS. 1, 3, and 5. Alternatively, the housing may extend along the bottom sides of the treadmill units (not shown). As illustrated, for example, in FIGS. 6 and 7, the housing may include a rail (or safety handle) 110 along at least one edge of the support surface 310 of the treadmill units 200*a*, 200*b*. The rail 110 in a further alternative embodiment may be detachable and relocatable, which is beneficial for studies that include filming the individual on the treadmill during a routine to compile 3-D images of the individual.

An alternative embodiment for the support structure is to add a connection hub 115 (shown, for example, in FIGS. 9 and 11) to provide a convenient place to run the wiring from the transducers, motor, and any other wiring within the treadmill. The connection hub 115 preferably has a plurality of jacks to connect to at least one external device for each of the internal wiring components.

Figure 8:
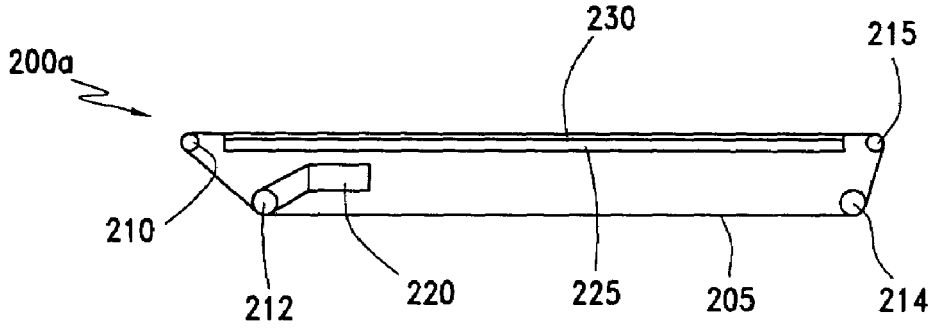
FIG. 8 illustrates a side view of the treadmill unit according to an embodiment of the invention.

As illustrated, for example, in FIGS. 6-8, an alternative embodiment for each of the treadmill units is to include a low-friction (or reduced friction) material 230 between the belt 205 and the forceplate 225. The reduced friction material 230 may, for example, be a solid piece such as a plate or a series of planks of low-friction material running laterally between the belt 205 and forceplate 225. Further, it would be preferable in this embodiment that the reduced friction material 230 is easily replaced; and more preferably the material 230 is stiff to accurately and completely transfer the forces received from the belt 205 to the forceplate 225. This alternative embodiment would minimize wear on the forceplate 225 by the belt 205 and vice versa. This embodiment also will improve the transfer of the horizontal forces applied by an individual's foot on the belt 205 to the forceplate 225 by minimizing the effect of friction either adding to the force or more likely acting to cancel a portion of the horizontal forces (particularly the lateral forces).

Figure 5:
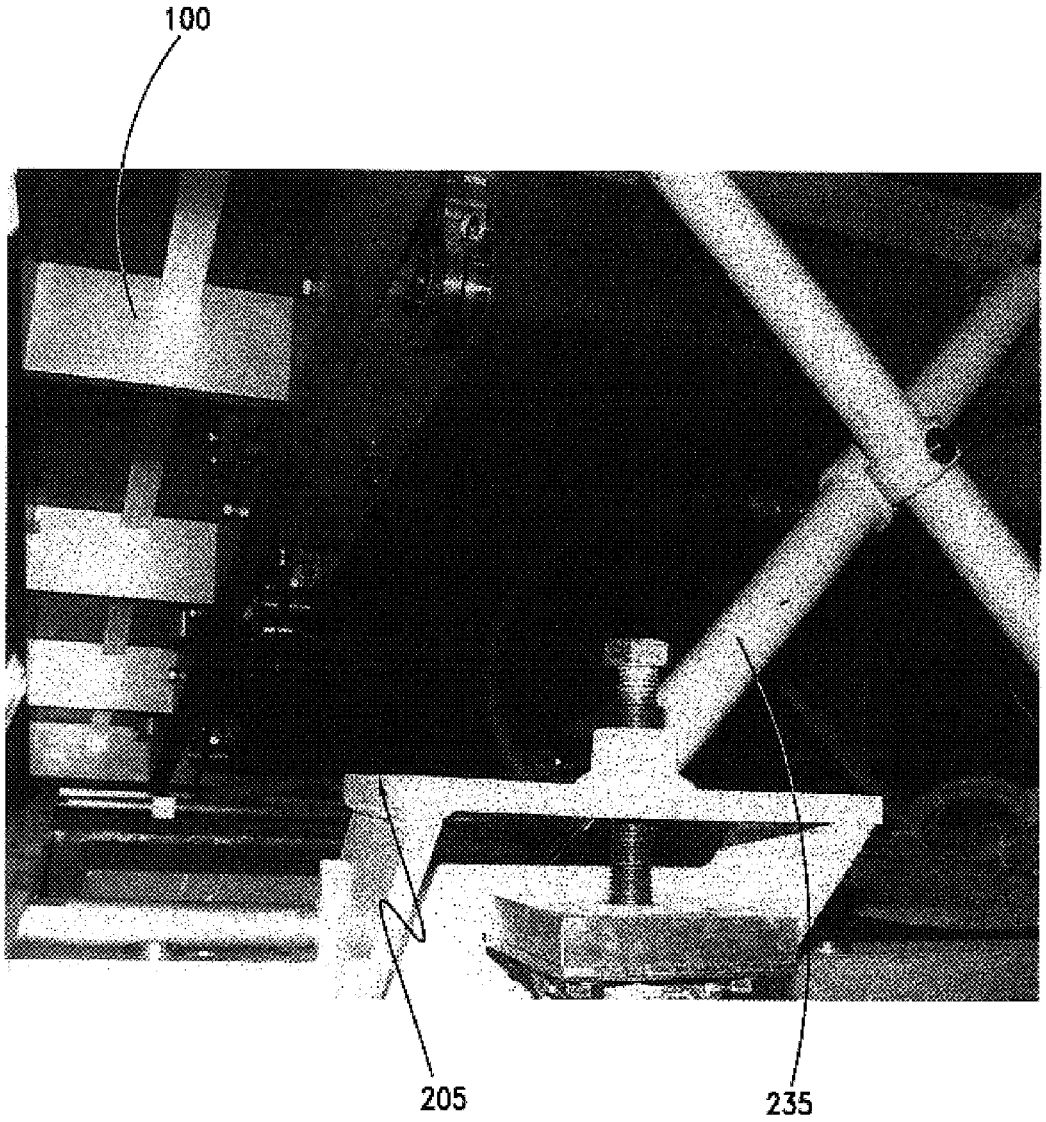
FIG. 5 illustrates a perspective view from underneath the treadmill unit according to an embodiment of the invention.

Another alternative embodiment is to include tensioning equipment that lengthens the belt path in each treadmill unit automatically in response to the stretching of the belt 205 during use as shown in FIG. 5. The tensioning equipment preferably pushes at least two of the rollers 212, 214 out from the center of the belt path.

Another alternative embodiment is to include a mechanism to change the grade of the treadmill surface from, for example, 0 to 25 percent grade. Preferably, the grade may allow for both an uphill and downhill capability while an individual is traversing the treadmill surface including changing between uphill and downhill during use. The preferred method of accomplishing this is by use of a jack mechanism 235 at the front and rear of the treadmill. More preferably, the jack structure is an X design with crossing legs driven with hydraulics as illustrated, for example, in FIGS. 5 and 9; however, other types of jack structures also would work. Further modification is to include a switch (not shown) that is tripped once one end is raised relative to the other end of the treadmill to prevent both ends being raised at once, where the switch is reset when the treadmill becomes level thus allowing an uphill segment to flow into a downhill segment. The jack(s) 235 preferably connects to the underside of the treadmill.

Figure 10:
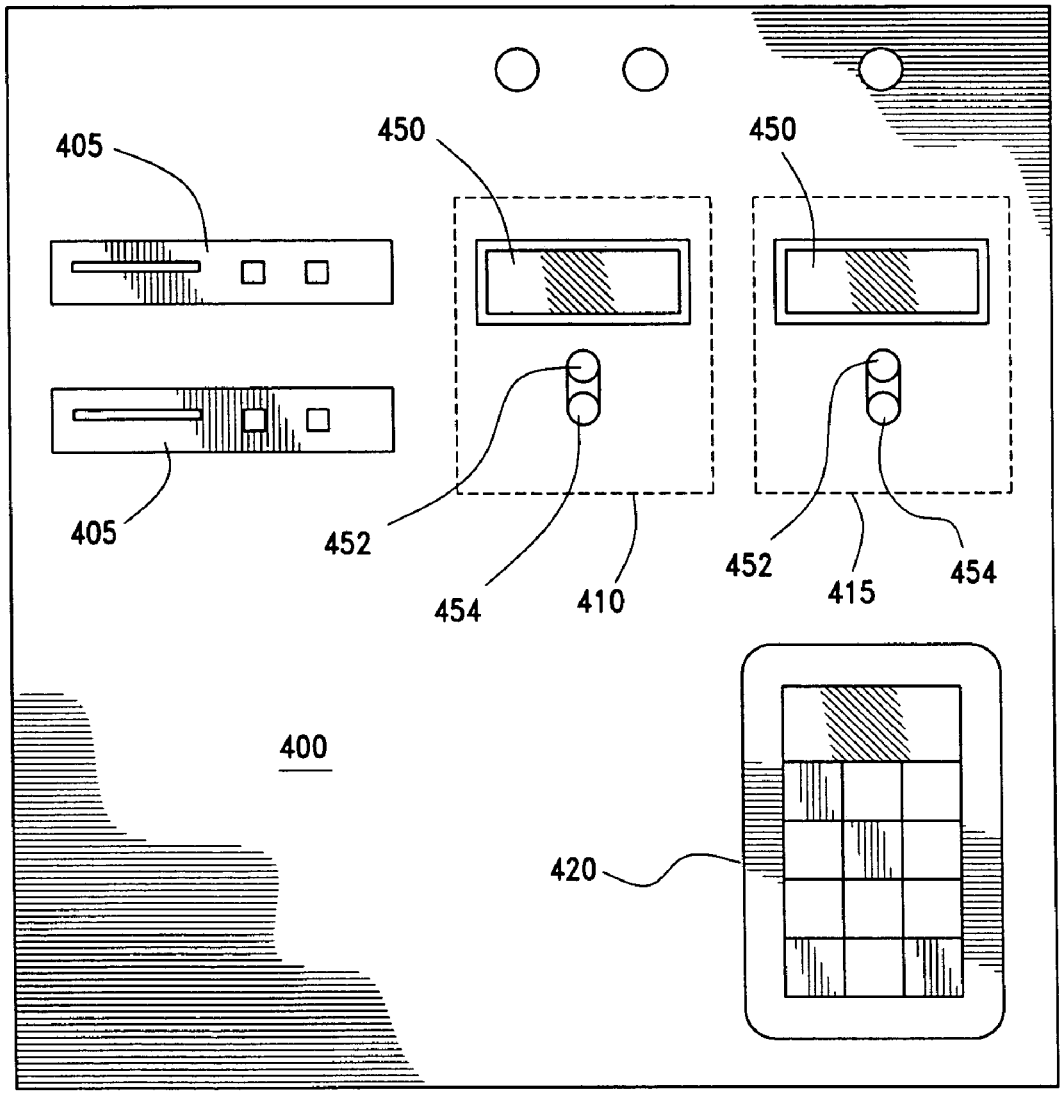
FIG. 10 illustrates an exemplary layout for an alternative embodiment of the invention.

A further modification to the above alternative embodiment or an alternative embodiment of its own is to include a podium 400 or other control interface such as a computer in the system as illustrated in FIG. 10. This arrangement allows for the programming of a course terrain in advance (or manual replication of it) in terms of inclines and declines that might be present in a particular course terrain. The podium 400 illustrated in FIG. 10 includes, for example, a pair of amplifiers 405, 405 (for amplifying the signal from the transducers in both treadmill units), a grade control 410, a speed control 415, a forward motor interface 420 that preferably is covered such that the display may be viewed but the motor not controlled, and a variety of other buttons associated with the operation of the treadmill units 200*a*, 200*b*. Each of the grade control 410 and speed control 415 preferably includes a display 450 to show the grade/speed currently for the treadmill and control buttons 452, 454 to increase/decrease the grade/speed of the treadmill.

Figure 9:
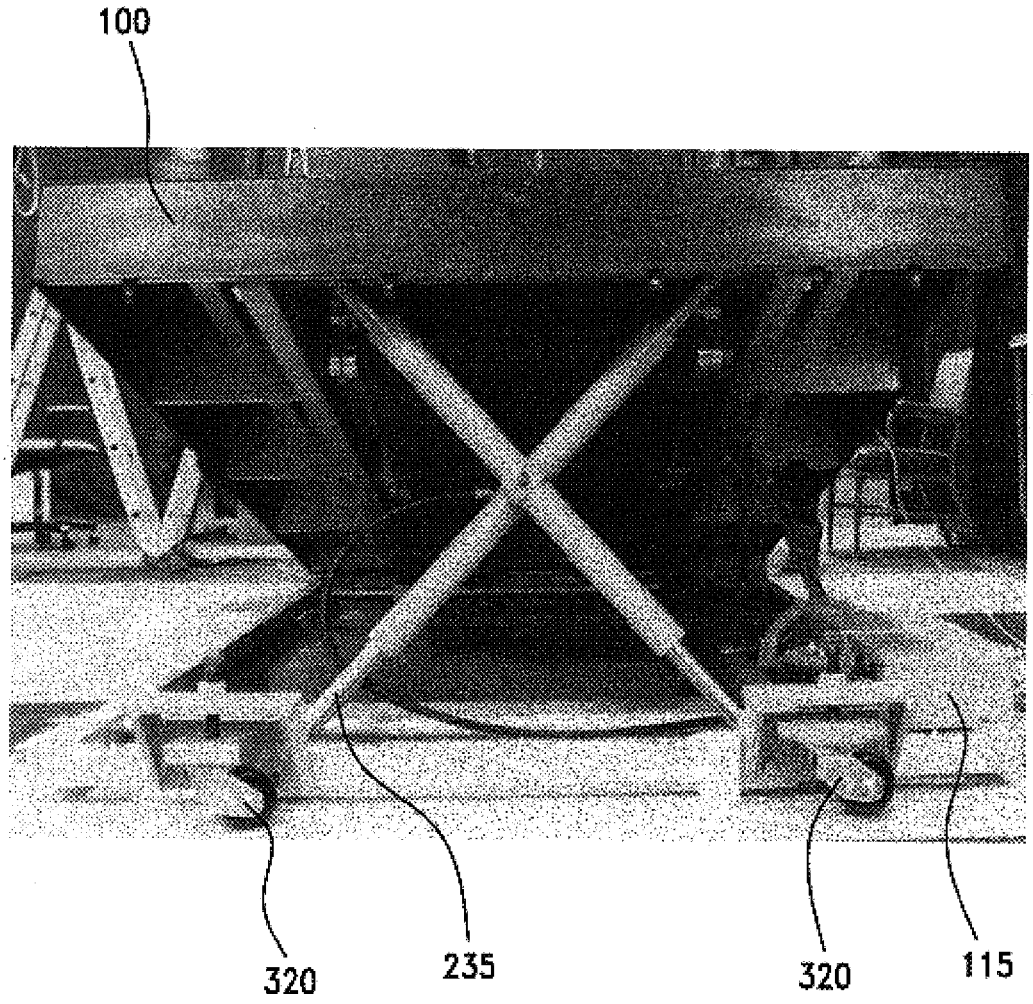
FIG. 9 depicts a front view of the treadmill unit according to an embodiment of the invention.

A further alternative embodiment is illustrated, for example, in FIGS. 3, 6, and 9. This embodiment adds a plurality of wheels 320 to the treadmill, more preferably four wheels each of which is proximate to a corner of the treadmill to allow easy transport of the treadmill about the lab or other setting. The illustrated embodiment places a pair of wheels 320 at each end of the treadmill spaced from each other and spaced from the corners although the wheels may be more proximate to the corners. The wheels 320 preferably are capable of being retracted to avoid inadvertent movement of the treadmill. In the illustrated embodiment in FIGS. 3, 6, and 9, the wheels 320 are retracted by screwing them up from the floor. The frames for the wheels 320 preferably extend out from the housing.

A still further alternative embodiment is to include a "kill" switch on the treadmill that the individual may use to stop the treadmill. An illustrative kill switch is shown in FIG. 7 as a push button switch 330 with wires aligned along the treadmill. Alternatively, a pull strap, which when pulled activates the kill switch, may be used in addition to or as a substitute to the push button.

A still further alternative embodiment is to include a plurality of reflective material on the housing to assist with analysis of video and image capture of an individual during use of the treadmill. Exemplary locations for the reflective material are illustrated at 360 in FIGS. 3, 4, and 6.

In addition to determining forces and torques exerted by each foot on each force plate of the treadmill, the present invention also presents a method for determining forces and torques exerted on each foot as it moves from one plate of the treadmill to another. Determining forces and torques exerted on each foot of an individual allows one to gain a more complete understanding of the condition of a patient during the patient's rehabilitation from injury, for example.

Figure 12:
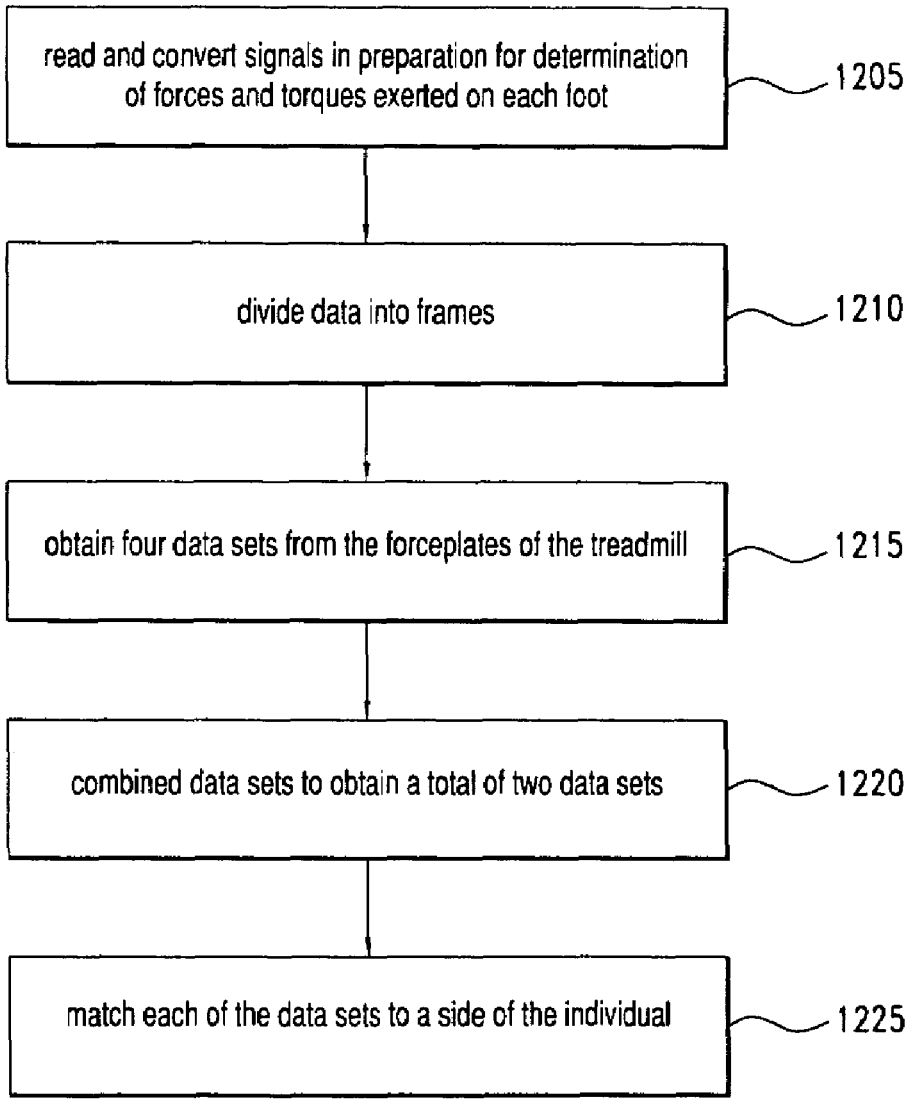
FIG. 12 is a flow diagram providing the general steps involved in determining forces and torques on each foot according to an embodiment of the invention.

In FIG. 12, a general overview of the steps involved in determining forces and torques exerted on each foot as it moves from one plate of the treadmill to another is provided. FIGS. 14(*a*)-19 provide an exemplary set of data that will be used to more fully describe the present invention.

In step 1205, signals are read and data from the signals is converted in preparation for the determination of forces and torques exerted on each foot.

In step 1210, the data is divided into frames to determine heel strikes and "toe offs."

In step 1215, a total of four data sets are obtained from the forceplates of the treadmill. Two of the four data sets represent data from the front forceplate of the treadmill, and two of the four data sets represent data from the rear forceplate of the treadmill.

In step 1220, two of the four data sets are combined to form a first set of data, and the other two data sets are combined to form a second set of data, thereby obtaining a total of two data sets.

In step 1225, each of the data sets in step 1220 is matched to a side of the individual.

Figure 13:
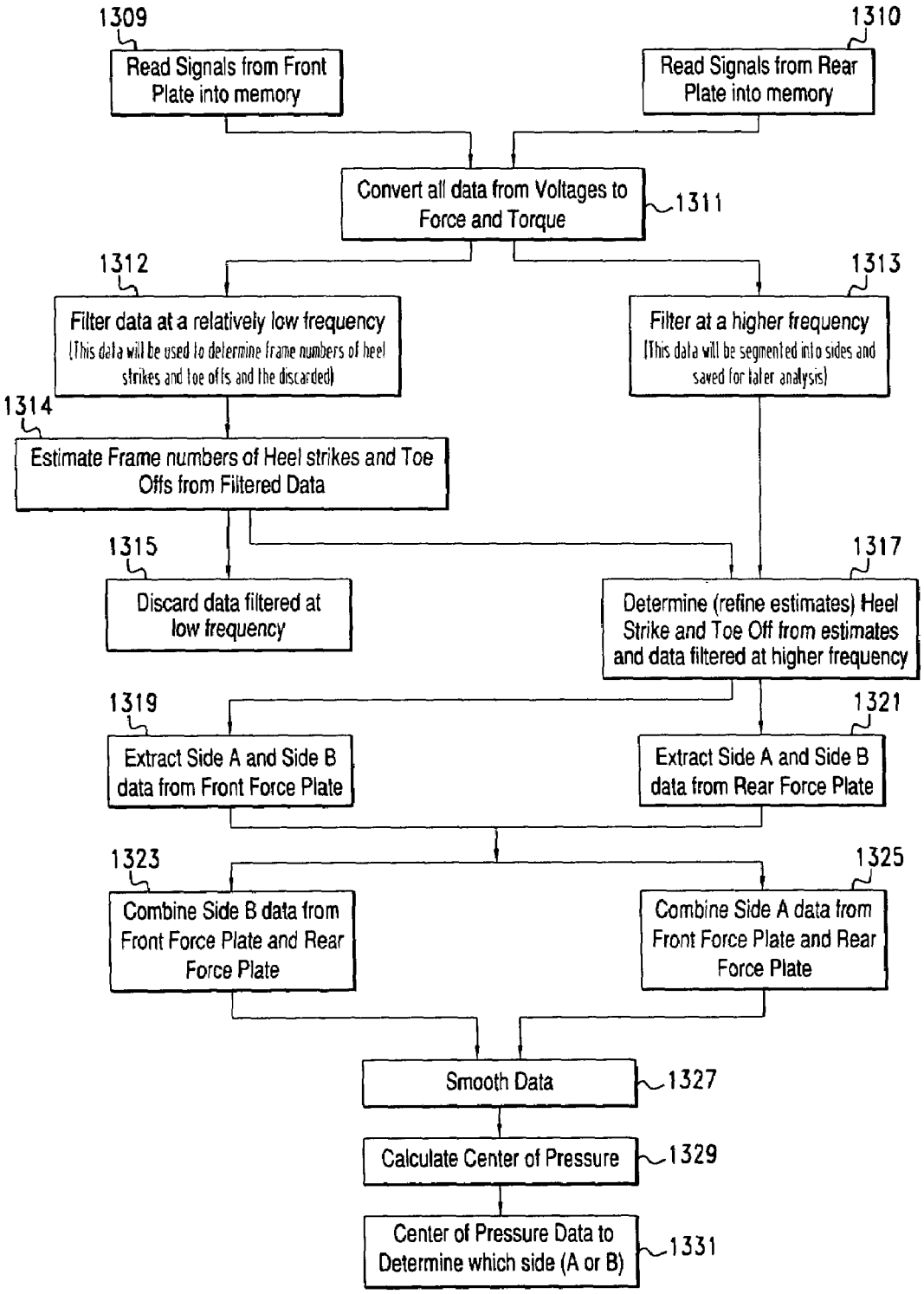
FIG. 13 is a flow diagram detailing the specific steps involved in determining forces and torques on each foot according to an embodiment of the invention.

FIG. 13 depicts a flow diagram of the steps involved in interpreting data of the forces and torques exerted on each forceplate to determine forces and torques exerted on each foot. The present invention preferably accepts signal data such as that illustrated in FIGS. 14(*a*) and 14(*b*) and ultimately obtains a data total corresponding to the left foot of the individual (front and rear forceplates combined) and another data total corresponding to the right foot of the individual (front and rear forceplates combined). The process begins with step 1305 in FIG. 13.

In step 1305, the six signals from the front forceplate of the treadmill are preferably received into a memory or file. Similarly, in step 1310, the six signals from the rear forceplate of the treadmill are preferably received into a memory or file. These signals will now be described with respect to FIGS. 14(*a*) and 14(*b*).

FIGS. 14(*a*) and 14(*b*) are diagrams depicting signals involved according to an embodiment of the present invention. This information is preferably provided by the treadmill of the present invention and is preferably in the form of electrical current that is representative to the forces and torques caused by the feet on the forceplates. For instance, data reading 1402*a* may represent a data reading resulting from a subject's left foot striking the front forceplate (that is, the subject's left stride) of the treadmill while data reading 1402*b* may represent a data reading resulting from a subject's right foot striking the front forceplate of the treadmill (that is, the subject's right stride), or visa versa.

In particular, FIGS. 14(*a*) and 14(*b*) show two exemplary sets of signals wherein FIG. 14(*a*) depicts signals from the front forceplate, and FIG. 14(*b*) depicts signals from the rear forceplate. The signals of FIG. 14(*a*) include the six signals 1402-1412 wherein each signal measures one of $F_x$, $F_y$, $F_z$, $M_x$, $M_y$, and $M_z$, respectively. Signal 1402, for example, measures $F_x$; signal 1404 measures $F_y$; signal 1406 measures $F_z$; signal 1408 measures $M_x$; signal 1410 (not shown) measures $M_y$; and signal 1412 (not shown) measures $M_z$. It should be noted that data from the front forceplate of the treadmill will preferably be divided into two data sets, as part of the method, namely, side A data and side B data. Side A data and side B data correspond to the two different sides of the individual walking on the treadmill. A determination will eventually be made as to which one of the individual's feet or sides corresponds to a particular dataset (that is, side A data or side B data). Similarly, data from the rear forceplate of the treadmill will eventually be divided into set A data and set B data.

It should also be noted that signal receipt is monitored over a period of time, for example, fifteen minutes of the individual walking or running on the treadmill. Over a period of time (for example, time $t_1$ to $t_{10}$), signal output for any given signal may vary. For example, at time $t_1$, output from the signal that measures $F_x$ (that is, signal 1402) may be stronger (that is, greater than), for example, than output from the same signal at a different time $t_3$, due to the varying of force and momentum applied on the forceplate by the individual's foot at the particular times.

In FIGS. 14(*a*) and 15(*a*), corresponding to the walking or running process (that is, the individual's strides), every other data peak reading over the given time period represents signal output data for the same side (for example, side A data) from the front forceplate of the treadmill. For example, if the data peak readings (1402*a*'s) at times $t_4$, $t_6$, and $t_8$ represent side A data from the front forceplate of the treadmill, the data readings (1402*b*'s) at time periods $t_5$ and $t_7$ both represent side B data from the front forceplate of the treadmill. It should be noted that the above is merely an example.

Similarly, FIGS. 14(*b*) and 15(*b*) includes the six signals 1414-1424 (signals 1422 & 1424 not shown) wherein each signal measures one of $F_x$, $F_y$, $F_z$, $M_x$, $M_y$, and $M_z$. Every other data peak reading over the given time period represents signal output data for same side data from the rear forceplate of the treadmill.

As will be appreciated by one of ordinary skill in the art, the present invention may be embodied as a computer implemented method, a programmed computer, a data processing system, a signal, and/or computer program. Accordingly, the present invention may take the form of an entirely hardware embodiment, an entirely software embodiment or an embodiment combining software and hardware aspects. Furthermore, the software embodiment may take the form of a computer program on a computer-usable storage medium having computer-usable program code embodied in the medium. Any suitable computer readable medium may be utilized including hard disks, CD-ROMs, optical storage devices, or other storage devices.

Computer program modules for carrying out operations of the present invention is preferably written in a plurality of languages including, for example, the C programming language, Ada, and C++. However, consistent with the invention, the computer program code for carrying out operations of the present invention may also be written in other conventional programming languages.

These computer program modules may also be stored in a computer-readable memory that can direct a computer or other programmable data processing apparatus to function in a particular manner. The instructions stored in the computer-readable memory can be used to produce an article of manufacture including instruction means or program code that implements the functions specified in the flowchart blocks.

The computer program instructions may also be loaded, e.g., transmitted via a carrier wave, to a computer or other programmable data processing apparatus. A series of operational steps are performed on the computer or other programmable apparatus to produce a computer implemented process such that the instructions which execute on the computer or other programmable apparatus provide steps for implementing the functions specified in the flowchart block or blocks.

Various templates and database(s) according to the present invention may be stored locally on a stand-alone computer such as a desktop computer, laptop computer, or the like. Exemplary stand-alone computers may include, but are not limited to, Apple®, Sun Microsystems®, IBM®, or Windows®-compatible personal computers.

Referring again to FIG. 13, it should be noted that steps 1305 and 1310 need not be executed in any particular order. For example, step 1310 may be executed before step 1305 (and vice versa), or steps 1305 and 1310 may be executed simultaneously.

In step 1311, the data from both the front forceplate and the rear forceplate is preferably converted from Voltages (as shown in FIGS. 14(*a*) and 14(*b*)) to forces and torques (for example, Newtons and Newton*Meters, as shown in FIGS. 15(*a*) and 15(*b*)). In at least one embodiment of the invention, the signals may be converted with the assistance of factory provided calibration values for the transducers being used.

In step 1312, the data from both the front forceplate and the rear forceplate is preferably filtered at a relatively low frequency (for example, as shown in FIGS. 16(*a*) and 16(*b*)) in preparation for determining or "marking" indices (i.e., to determine frame numbers of heel strikes and toe offs). For example, in at least one embodiment of the invention, all data is preferably filtered at approximately five Hertz. It should be noted, however, that the data may be filtered at other appropriate specifications. It should also be noted that a copy of the original unfiltered data is maintained in the memory, for example.

In step 1313, all data in the original, unfiltered copy of data stored in the memory is preferably filtered at a higher frequency than before, as the data filtered at the low frequency (in step 1312) is inappropriate for use in further processing. For example, the original data is preferably filtered at approximately twenty Hertz to obtain the data at a higher frequency. It should be noted, however, that other filter specifications are also possible. The data is preferably filtered to allow eventual calculation of center of pressure. In at least one embodiment, however, the original unfiltered data is preferably used in further processing. In such an embodiment, after calculating center of pressure, the filtered data (in step 1313) is discarded.

In step 1314, indices or frame numbers are preferably estimated from the filtered data (i.e., from the data filtered in step 1312). It should be noted that a threshold value (for example, five percent of the maximum value in the dataset) is preferably initially set by a user for each stride of an individual walking on the treadmill. A stride includes a stance phase and a swing phase. The stance phase is defined by a heel strike to a toe off. The swing phase is the time between a toe off and a heel strike. To ensure data accuracy and reliability, for each first stride of the individual walking on the treadmill that exceeds the initial threshold value, its associated frame number or index is preferably determined to extract strides of data (that is, side A data and side B data). It should be noted that each of side A and side B data, represented by a frame number, has a beginning point and an ending point. For example, FIGS. 17(*a*) and 17(*b*) illustrate converted signal data marked with frames for the signals in FIGS. 15(*a*) and 15(*b*), respectively, after indices have been determined to "mark" data strides. As shown in FIG. 17(*a*), for example, frame 1, the first frame for the corresponding stride (for example, left stride) that includes a datavalue exceeding the initial set threshold value has a beginning point "$a_1$" and an ending point "$z_1$." Similarly, frame number 2, the first frame for the corresponding stride (for example, right stride) that includes a data value exceeding the initial set threshold value has a beginning point "$a_2$" and an ending point "$z_2$." Frame number 3, the first frame corresponding to the next stride (another left stride) that includes a data value exceeding the initial set threshold value has a beginning point "$a_3$" and an ending point "$z_3$" also, and so forth. It should be noted, however, that in accordance with the definition of walking, $a_y$ (the beginning point for any given frame number y) on the front plate occurs before $z_x$ (the ending point for the frame immediately preceding frame y) on the rear plate. The amount of time between $a_y$ on the frontplate and $z_x$ on the rear plate preferably varies.

It should be noted that in at least one embodiment of the invention, a verification step is performed to ensure that each frame has a beginning point and an ending point.

In step 1315, after the frame numbers for the heel strikes and toe offs are determined, the data filtered at the low frequency is preferably discarded.

In step 1317, the data filtered at the high frequency is maintained in the memory for further processing. Heel strikes and toe offs from the estimated data in step 1314 are also determined.

In step 1319, data for each of side A and side B is extracted from the front forceplate of the treadmill and accumulated. For instance, to accumulate side A data, every other frame of data (for example, all 1402*a*'s in FIG. 15(*a*)) is extracted and placed into a file, for example.

In step 1321, data for side A and side B is extracted from the rear forceplate of the treadmill. Thus, after the data extraction process in steps 1319 and 1321, there are a total of four data sets. Two of the four data sets are from the front forceplate of the treadmill wherein the data sets are side A data and side B data. The other two data sets are from the rear forceplate of the treadmill. These data sets are side A data and side B data. It should be noted that steps 1319 and 1921 may occur in any order. For example, step 1321 may precede step 1319, or the steps may occur simultaneously.

In step 1323, data from the front and rear forceplates of the treadmill is combined. In particular, for each corresponding signal pair that measures the same variable, side B data is accumulated to obtain a side B total.

Similarly, in step 1325, data from the front and rear forceplates of the treadmill is combined. In particular, for each corresponding signal pair that measures the same variable, side A data is accumulated to obtain a side A total. It should be noted that steps 1323 and 1325 need not occur in any particular order. For example, step 1325 may precede step 1323, or the steps may occur simultaneously.

For example, referring to FIGS. 15(*a*) and 15(*b*), signal 1402 and signal 1414 both measure the variable $F_x$ and are therefore considered corresponding signal pairs. Thus, for the corresponding signal pair 1402 and 1414, all side A data is accumulated to obtain one side A total as described in step 1325, representing data from both the front and rear forceplates of the treadmill, as depicted in FIG. 18(*a*). Similarly, for the same corresponding signal pair, all side B data is accumulated to obtain one side B total as described in step 1323, representing data from both the front and rear forceplates of the treadmill, as depicted in FIG. 18(*b*). The same process is preferably performed for the remaining corresponding signals pairs. It should be noted that at the end of step 1325, there will be two sets of data, namely side A data and side B data, as depicted in FIGS. 18(*a*) and 18(*b*).

In step 1327, all data is smoothed to ensure a smooth transition from the front forceplate to the rear forceplate. After being presented with the disclosure herein, one skilled in the relevant art will realize that a variety of data smoothing algorithms may be utilized in the present invention.

In step 1329, a trajectory of the placement of each foot as it moves on the treadmill is preferably calculated from moment data (for instance $M_x$ and $M_y$). Thus, the moment data is preferably used to determine which trajectory is the right foot and which trajectory is the left foot. This calculation process is known as calculating the Center of Pressure.

At this particular point in the process, side A data and side B data has been obtained. It has not been determined, however, whether side A data corresponds to the individual's left side/foot or right side/foot. Nor has it been determined whether side B data corresponds to the individual's left side/foot or right side/foot.

Thus, in step 1331, the center of pressure data calculated in step 1329 must be utilized to determine which side data (that is, side A data or side B data) corresponds to which side of the individual (that is, the individual's left side/foot or the individual's right side/foot). In the example illustrated in FIG. 19, trajectory 1905 (side A data) is to the right of trajectory 1910 (side B data). Thus, a determination is preferably made that side A data corresponds to the individual's right side/foot, and side B data corresponds to the individual's left side/foot.

After being presented with the disclosure herein, one skilled in the relevant art will realize that other methods of determining which side data corresponds to which side of the individual's body may be used.

Although the present invention has been described in terms of particular preferred embodiments, it is not limited to those embodiments. Alternative embodiments, examples, and modifications which would still be encompassed by the invention may be made by those skilled in the art, particularly in light of the foregoing teachings. The preferred and alternative embodiments described above may be combined in a variety of ways with each other. Furthermore, the dimensions, shapes sizes, and numbers of the various pieces illustrated in the Figures may be adjusted from those shown.

Furthermore, those skilled in the art will appreciate that various adaptations and modifications of the above-described preferred embodiments can be configured without departing from the scope and spirit of the invention. Therefore, it is to be understood that, within the scope of the appended claims, the invention may be practiced other than as specifically described herein.

We claim:

1. A method for interpreting data representing forces and torques exerted by a right and left foot on a first and second plate treadmill to determine forces and torques exerted on the right and left foot, over a specified period of time, comprising:

(a) receiving a plurality of signals from the first and second plates in Voltages;

(b) converting said data from Voltages to forces and torques with calibration values;

(c) analyzing the plurality of signals from the first and second plates to determine an occurrence of heel-strikes on the plates and toe-off events from the plates;

(d) filtering said data at a first frequency appropriate for determining frame numbers;

(e) filtering said data at a second frequency wherein said second frequency is higher than said first frequency;

(f) for each one of said plurality of signals, determining frame numbers corresponding to a stride of an individual wherein each frame number includes a beginning point and an ending point;

(g) extracting data for a first side and a second side from each of the first and second plates to obtain a first side data total and a second side data total; and (h) determining which one of the right and left foot corresponds to said first side data and which one corresponds to said second side data.

2. The method of claim 1, wherein said forces and torques are measured in an X-axis, a Y-axis, and a Z-axis.

3. The method of claim 1, wherein at least one file is utilized to accumulate all data.

4. The method of claim 1, further comprising calculating a Center of Pressure.

5. The method of claim 1, wherein step (c) further includes refining said frame numbers to ensure that each said beginning point is paired with an ending point.

6. A method for interpreting data representing forces and torques exerted by a right and left foot on a first and second plate treadmill to determine forces and torques exerted on the right and left foot, over a specified period of time comprising:

(a) analyzing a plurality of signals from the first and second plates to determine an occurrence of heel-strikes on the plates and toe-off events from the plates;

(b) filtering said data at a first frequency appropriate for determining frame numbers;

(c) filtering said data at a second frequency wherein said second frequency is higher than said first frequency;

(d) for each one of said plurality of signals, determining frame numbers corresponding to a stride of an individual wherein each frame number includes a beginning point and an ending point;

(e) extracting data for a first side and a second side from each of the first and second plates to obtain a first side data total and a second side data total, extracting data includes (i) accumulating first side data from said first forceplate, (ii) accumulating second side data from said first forceplate, (iii) accumulating first side data from said second forceplate, and (iv) accumulating second side data from said second forceplate; and (f) determining which one of the right and left foot corresponds to said first side data and which one corresponds to said second side data.

7. The method of claim 6, wherein step (b) further comprises, for each one of a corresponding pair of said plurality of signals measuring a same component in a same directional axis, accumulating all first side data to obtain a first side total and accumulating all second side data to obtain a second side total.

8. A method for interpreting data representing forces and torques exerted by a right and left foot on a first and second plate treadmill to determine forces and torques exerted on the right and left foot, over a specified period of time, comprising:

(a) analyzing a plurality of signals from the first and second plates to determine an occurrence of heel-strikes on the plates and toe-off events from the plates;

(b) for each one of said plurality of signals, determining frame numbers corresponding to a stride of an individual wherein each frame number includes a beginning point and an ending point;

(c) extracting data for a first side and a second side from each of the first and second plates to obtain a first side data total and a second side data total; and (d) determining which one of the right and left foot corresponds to said first side data and which one corresponds to said second side data, determining includes (i) calculating a trajectory of a placement of each one of said feet as it moves on the treadmill, said trajectory calculation based on centers of pressure using moment data, and (ii) determining which one of said trajectories corresponds to an individual's right foot and which one of said trajectories corresponds to an individual's left foot.

9. A method for interpreting data representing forces and torques exerted by a right and left foot on a first and second plate treadmill to determine forces and torques exerted on the right and left foot, over a specified period of time, comprising:

(a) analyzing data including a plurality of signal outputs from the first and second plates to determine an occurrence of heel-strikes on the plates and toe-off events from the plates;

(b) dividing said data into frames, each of said frames being an odd-numbered frame or an even-numbered frame;

(c) separating said data into side A data and side B data, separating includes (i) accumulating data from said odd-numbered frames from said first plate and placing said data from said odd-numbered frames into a first file, (ii) accumulating data from said even-numbered frames from said first plate and placing said data from said even-numbered frames into a second file, (iii) accumulating data from said odd-numbered frames from said second plate and placing said data from said odd-numbered frames into a third file, and (iv) accumulating data from said even-numbered frames from said second plate and placing said data from said even-numbered frames into a forth file; and (d) determining which one of the right and left foot corresponds to said side A data and which one corresponds to said side B data, determining includes (i) calculating a trajectory of a placement of each one of said feet as it moves on the treadmill, said trajectory calculation based on centers of pressure using moment data, and (ii) determining which one of said trajectories corresponds to an individual's right foot and which one of said trajectories corresponds to an individual's left foot.

10. The method of claim 9, further comprising:

(v) adding said data from steps (i) and (iii) to obtain data for side A; and (vi) adding said data from steps (ii) and (iv) to obtain data for side B.

* * * * *